US008100490B2

(12) United States Patent
Matsumoto

(10) Patent No.: US 8,100,490 B2
(45) Date of Patent: Jan. 24, 2012

(54) LIQUID STORAGE DEVICE AND LIQUID PRESENCE DETERMINING METHOD

(75) Inventor: Hitoshi Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 437 days.

(21) Appl. No.: 12/416,221

(22) Filed: Apr. 1, 2009

(65) Prior Publication Data

US 2009/0251517 A1 Oct. 8, 2009

(30) Foreign Application Priority Data

Apr. 2, 2008 (JP) ..... 2008-096547

(51) Int. Cl.
*B41J 2/195* (2006.01)
*B41J 2/175* (2006.01)
*B01F 13/08* (2006.01)

(52) U.S. Cl. ..... 347/7; 347/85; 366/273

(58) Field of Classification Search ..... 347/6, 7
See application file for complete search history.

(56) References Cited

U.S. PATENT DOCUMENTS

| | | | | |
|---|---|---|---|---|
| 3,751,975 | A * | 8/1973 | Katsura | 73/54.38 |
| 5,963,236 | A * | 10/1999 | Miyashita et al. | 347/85 |
| 6,065,865 | A * | 5/2000 | Eyraud et al. | 366/273 |
| 2005/0087002 | A1 * | 4/2005 | Kanzaki et al. | 73/54.28 |

FOREIGN PATENT DOCUMENTS

| | | |
|---|---|---|
| JP | 2005-067122 | 3/2005 |
| JP | 2006-326929 | 12/2006 |
| JP | 2006-327102 | 12/2006 |

* cited by examiner

*Primary Examiner* — Shelby Fidler
(74) *Attorney, Agent, or Firm* — Workman Nydegger

(57) ABSTRACT

A liquid storage device includes a storage portion that is configured to store liquid therein, a rotating member that is provided in a bottom portion at inside of the storage portion so as to be capable of rotating, a driving member that is provided at outside of the storage portion in a non-contact state with respect to the rotating member so as to drive the rotating member by magnetic force, the driving member rotating to allow the rotating member to rotate, a detecting portion that is capable of detecting a degree of rotation of the rotating member, and a determining portion that is capable of acquiring difference information of rotation between the rotating member and the driving member on the basis of a detection result by the detecting portion and determining presence of liquid in the storage portion on the basis of the difference information.

7 Claims, 8 Drawing Sheets

LIQUID STORAGE DEVICE AND LIQUID PRESENCE DETERMINING METHOD

BACKGROUND

The entire disclosure of Japanese Patent Application No. 2008-096547, filed Apr. 2, 2008, is expressly incorporated herein by reference.

1. Technical Field

The present invention relates to a liquid storage device and a liquid presence determining method.

2. Related Art

A liquid storage device which is provided with a storage portion storing liquid therein is already known. An ink jet printer, which is provided with a storage portion (an ink storage portion of an ink cartridge) storing ink therein, is an example of the liquid storage device.

In the ink jet printer, ink is supplied from the ink storage portion to a head.

JP-A-2006-326929, JP-A-2006-327102, and JP-A-2005-067122 are examples of the prior art.

When the supply of ink from the ink storage portion to the head is repeated, the ink in the ink storage portion will be exhausted (that is, an ink end occurs). In such a case, there is necessity of informing a user of the occurrence of the ink end to prompt the user to replace the ink cartridge. Therefore, there is a need to appropriately determine presence of ink in the ink storage portion.

SUMMARY

An advantage of some aspects of the invention is that it provides a novel and effective liquid presence determining method.

According to an aspect of the invention, there is provided a liquid storage device including: a storage portion that is configured to store liquid therein, a rotating member that is provided in a bottom portion at inside of the storage portion so as to be capable of rotating, a driving member that is provided at outside of the storage portion in a non-contact state with respect to the rotating member so as to drive the rotating member by magnetic force, the driving member rotating to allow the rotating member to rotate, a detecting portion that is capable of detecting a degree of rotation of the rotating member, and a determining portion that is capable of acquiring difference information of rotation between the rotating member and the driving member on the basis of a detection result by the detecting portion and determining presence of liquid in the storage portion on the basis of the difference information.

These and other features of the invention will be more fully apparent from the following description and accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
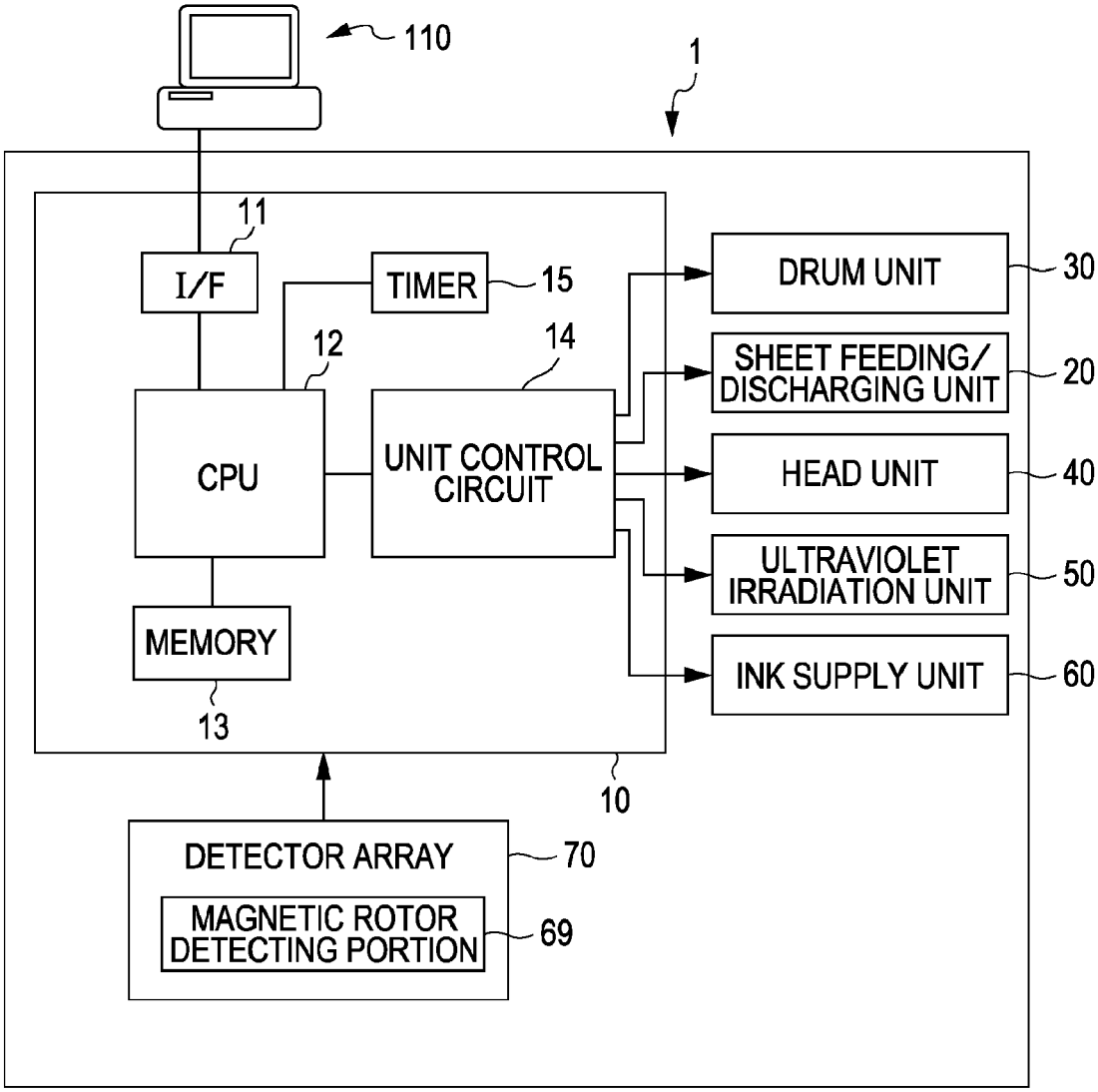
FIG. 1 is a block diagram showing the entire structure of a printer 1 according to a first embodiment of the invention.

The following aspects of the invention will be apparent from the following description and accompanying drawings.

According to a first aspect of the invention, there is provided a liquid storage device including: a storage portion that is configured to store liquid therein, a rotating member that is provided in a bottom portion at inside of the storage portion so as to be capable of rotating, a driving member that is provided at outside of the storage portion in a non-contact state with respect to the rotating member so as to drive the rotating member by magnetic force, the driving member rotating to allow the rotating member to rotate, a detecting portion that is capable of detecting a degree of rotation of the rotating member, and a determining portion that is capable of acquiring difference information of rotation between the rotating member and the driving member on the basis of a detection result by the detecting portion and determining presence of liquid in the storage portion on the basis of the difference information.

According to the liquid storage device, a novel and effective liquid presence determining method can be provided.

In accordance with another embodiment of the invention, the liquid storage device has such a configuration that the detecting portion detects a rotation amount of the rotating member as the degree of rotation, and that the determining portion is configured to: acquire a difference between the rotation amount per predetermined time period of the rotating member and an instructed rotation amount per predetermined time period of the driving member as difference information on the basis of the detection result by the detecting portion, and determine the presence of liquid in the storage portion on the basis of the difference.

Owing to such a configuration, the device structure can be simplified.

In accordance with a further embodiment of the invention, the liquid storage device has such a configuration that the detecting portion is a first detecting portion and includes a second detecting portion for detecting the rotation amount of the driving member, that the first detecting portion detects the rotation amount of the rotating member as the degree of rotation, and that the determining portion is configured to: acquire a difference in the rotation amount per predetermined time period between the rotating member and the driving member as the difference information on the basis of the detection results by the first detecting portion and the second detecting portion, and determine the presence of liquid in the storage portion on the basis of the difference.

Owing to such a configuration, it is possible to determine the presence of liquid in the storage portion in an accurate manner.

In accordance with a still further embodiment of the invention, the liquid storage device has such a configuration that the rotating member is a pump member for delivering the liquid from the storage portion.

Owing to such a configuration, the members can be efficiently utilized.

In accordance with a still further embodiment of the invention, the liquid storage device has such a configuration that the liquid storage device further includes a flow path which is connected to the storage portion and through which the liquid delivered from the storage portion by the pump member flows and a valve for opening/closing the flow path, that the detecting portion detects the degree of rotation of the rotating member when the valve is closed.

Owing to such a configuration, it is possible to determine the presence of liquid in the storage portion in an accurate manner.

In accordance with a still further embodiment of the invention, the liquid storage device has such a configuration that the rotating member is an agitating member for agitating the liquid in the storage portion.

Owing to such a configuration, the members can be efficiently utilized.

According to a second aspect of the invention, there is provided a liquid presence determining method including the steps of: allowing a rotating member provided in a bottom portion at inside of a storage portion storing liquid therein to rotate by rotating a driving member provided at outside of the storage portion in a non-contact state with respect to the rotating member, the driving member driving the rotating member by magnetic force, thereby detecting a degree of rotation of the rotating member, and acquiring difference information on rotation between the rotating member and the driving member on the basis of a detection result and determining presence of liquid in the storage portion on the basis of the difference information.

According to the liquid presence determining method, a novel and effective liquid presence determining method can be provided.

Overview of Ink Jet Printer

An exemplary configuration of a printer 1 and an exemplary printing operation will be described by way of an example of an ink jet printer (hereinafter, referred to as printer 1) as an example of a liquid storage device.

Structure of Printer 1

Figure 2:
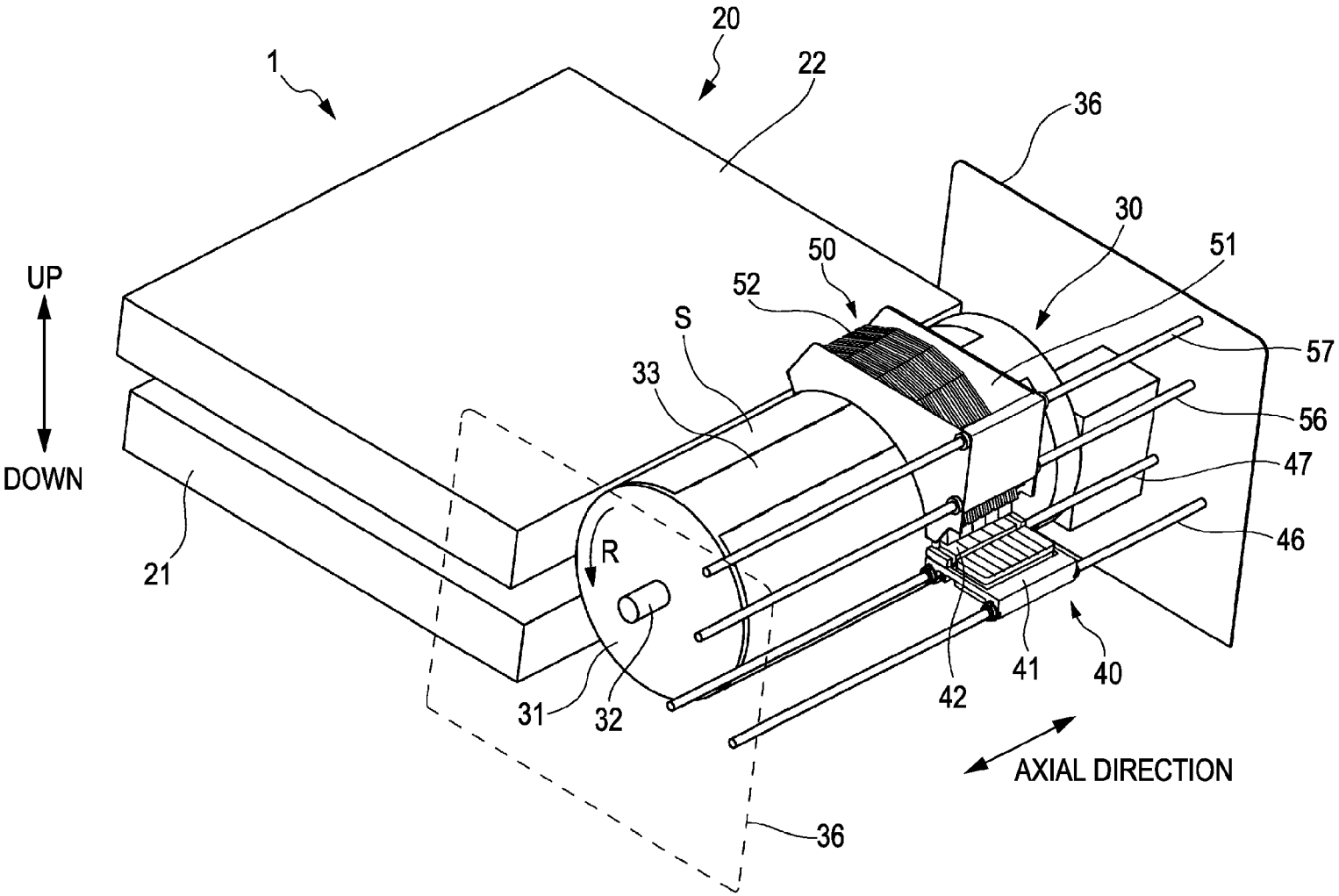
FIG. 2 is a schematic diagram showing a structure of a main portion of the printer 1.
Figure 3:
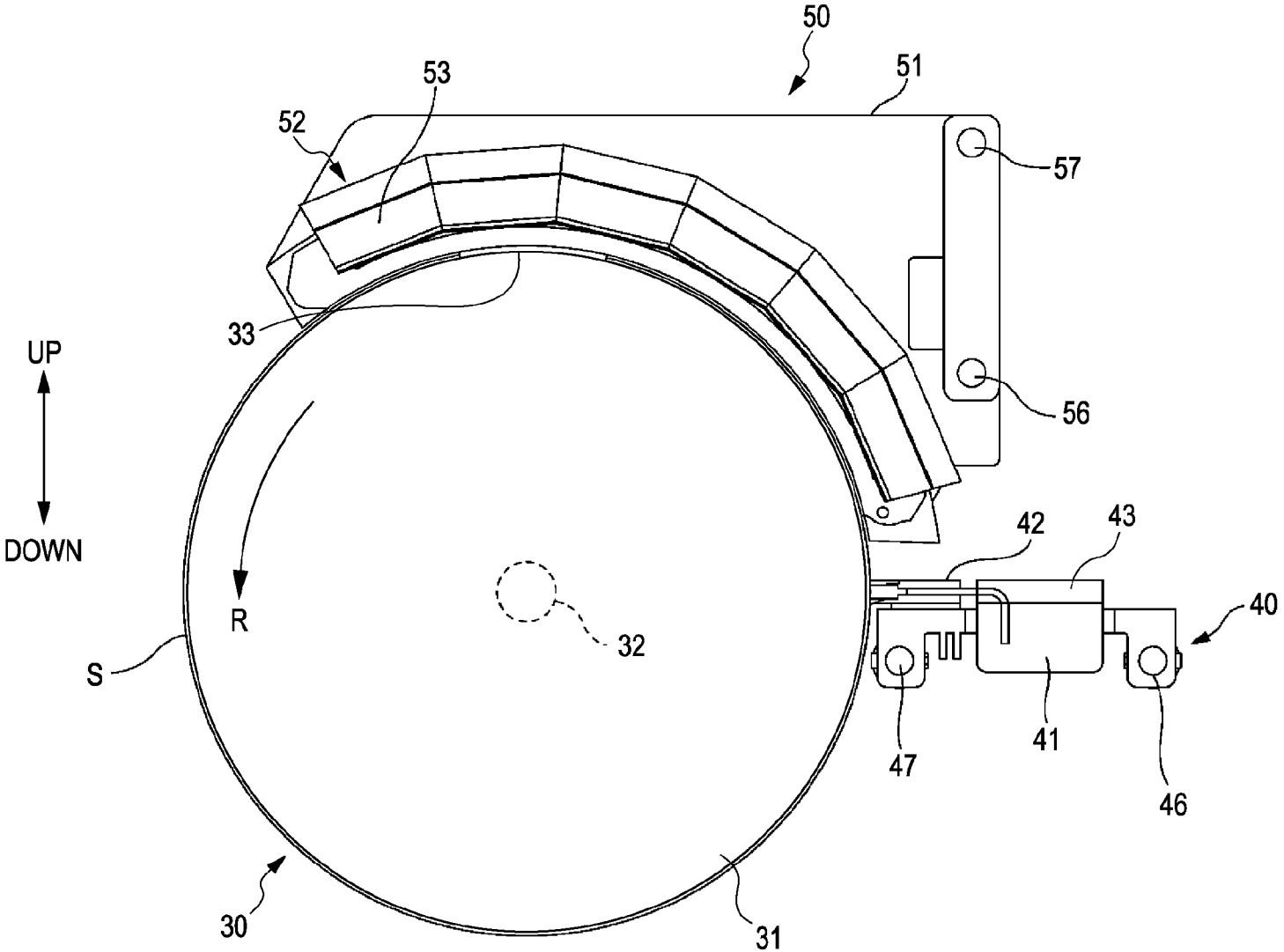
FIG. 3 is a diagram showing a sectional structure of a drum unit 30, a head unit 40 and an ultraviolet irradiation unit 50.
Figure 4A:
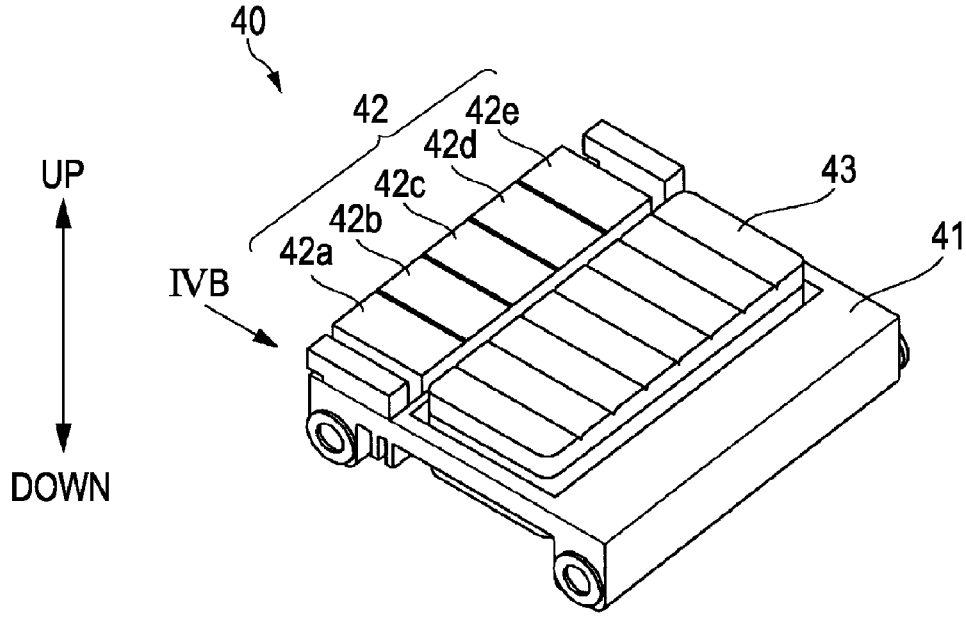
FIG. 4A is a perspective view of the head unit 40.
Figure 4B:
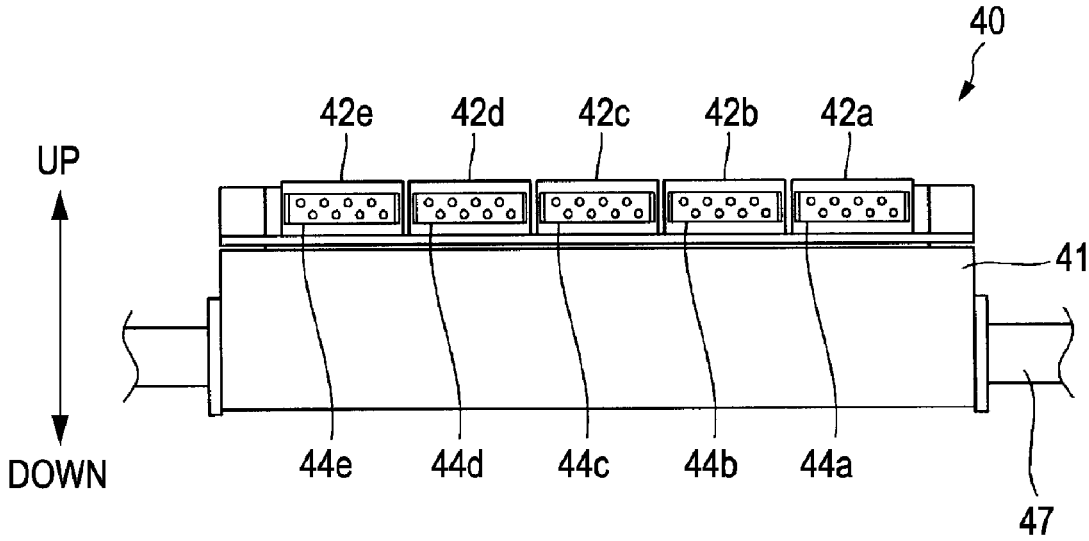
FIG. 4B is a front view of a head 42 when the head 42 is seen from a direction indicated by the arrow IVB in FIG. 4A.

FIG. 1 is a block diagram showing the entire structure of a printer 1 according to a first embodiment of the invention. FIG. 2 is a schematic diagram showing a structure of a main portion of the printer 1. FIG. 3 is a diagram showing a sectional structure of a drum unit 30, a head unit 40 and an ultraviolet irradiation unit 50. FIG. 4A is a perspective view of the head unit 40, and FIG. 4B is a front view of a head 42 when the head 42 is seen from a direction indicated by the arrow IVB in FIG. 4A.

Upon receiving print data from a computer 110 which is an external device, the printer 1 controls respective units (a sheet feeding/discharging unit 20, a drum unit 30, a head unit 40, an ultraviolet irradiation unit 50, and an ink supply unit 60) by means of a controller 10 to thereby form images on a sheet S (printing operation). The internal state of the printer 1 is monitored by a detector array 70, and the controller 10 controls the respective units based on the detection results.

The controller 10 is a control unit for controlling the printer 1. An interface portion 11 performs data communication between the computer 110, which is an external device, and the printer 1. A CPU 12 is an arithmetic processing unit for controlling the entire operations of the printer 1. A memory 13 is provided to secure an area for storing programs of the CPU 12, a work area, and the like. The CPU 12 controls the respective units by means of a unit control circuit 14 in accordance with the programs stored in the memory 13. A timer 15 counts time.

A sheet feeding/discharging unit 20 is configured to include a sheet feeding portion 21 and a sheet discharging portion 22 as shown in FIG. 2. The sheet feeding portion 21 includes a sheet feeding roller (not shown) for transporting the sheet S, so that the sheet S stacked in the sheet feeding portion 21 is fed to a drum unit 30 one by one. The sheet discharging portion 22 includes a sheet discharging roller (not shown) for transporting the sheet S, so that the printed sheet S supported on the drum unit 30 is discharged into the sheet discharging portion 22.

The drum unit 30 includes a holding drum 31 configured to hold the sheet S fed from the sheet feeding portion 21 thereon. The holding drum 31 has a rotation shaft thereof 32 being rotatably supported by a pair of frames 36. The holding drum 31 rotates in the direction of the arrow R shown in FIG. 2 in a state in which the sheet S is held on an outer circumferential surface 33 thereof.

The head unit 40 includes a head carriage 41 which is supported by a pair of guide shafts 46 and 47 and is capable of reciprocating in the axis direction of the holding drum 31. The head carriage 41 is provided with a head 42 therein that ejects ink as an example of liquid onto the sheet S. In the present embodiment, as the head 42, five heads 42*a* to 42*e* (FIG. 4B) configured to eject ink of different colors are arranged to oppose the sheet S held on the holding drum 31. Moreover, the respective heads 42*a* to 42*e* have nozzle plates 44*a* to 44*e* having formed a plurality of nozzles therein and ink is ejected from the respective nozzles. A pressure chamber (not shown) filled with ink and a driving element (piezoelectric element) that varies volume of the pressure chamber to eject ink are provided in each nozzle.

A storage chamber 43 storing ink therein is provided in the head carriage 41. A predetermined amount of ink is supplied from the storage chamber 43 to the head 42. In the present embodiment, ultraviolet curable ink that is cured by irradiation of ultraviolet rays is used as the ink. The ultraviolet curable ink is made by adding auxiliary substance such as an antifoaming agent or a polymerization inhibitor to a mixture of a vehicle, a photopolymerization initiator and a pigment. The vehicle is made from oligomer or monomer having a photopolymerization curing property by adjusting the viscosity thereof using a reactive diluent.

The ultraviolet irradiation unit 50 includes an irradiating unit carriage 51 which is supported by a pair of guide shafts 56 and 57 and is capable of reciprocating in the axis direction of the holding drum 31. In the irradiation unit carriage 51, an ultraviolet irradiation portion 52 that irradiates ultraviolet rays onto ink which is ejected from the head 42 and adhered onto the sheet S is provided. The ultraviolet irradiation portion 52 includes a plurality of lamps 53 which is arranged along the rotation direction of the holding drum 31. The plurality of lamps 53 irradiate ultraviolet rays onto the ink on the sheet S, whereby the ink is cured.

An ink supply unit 60 is configured to supply ink to the storage chamber 43 when the amount of ink in the head unit 40 (specifically, the storage chamber 43) decreases due to the ejection of ink by the head 42. Details of the ink supply unit 60 will be described later.

Printing Operation

Upon receiving a print command and print data from the computer 110, the controller 10 analyzes the contents of various commands contained in the print data to perform the following printing operations by using the respective units.

First, the sheet feeding portion 21 feeds the sheet S toward the holding drum 31. The sheet S fed to the holding drum 31 is held in a state of being wound around the outer circumferential surface 33. The held sheet S rotates together with the holding drum 31. The respective head 42 ejects ink to the rotating sheet S to be adhered thereon. The ink adhered on the sheet S moves with the rotation of the holding drum 31 and ultraviolet rays are irradiated thereto by the ultraviolet irradiation portion 52. In this way, the ink on the sheet S is cured, and images are formed on the sheet S.

When images are printed on the sheet S in a partial region in the axis direction of the holding drum 31 during one revolution of the holding drum 31, the head carriage 41 is moved along the guide shafts 46 and 47 (the irradiation unit carriage 51 is also moved along the guide shafts 56 and 57). The above-described operation (ink ejection by the head 42 and ultraviolet irradiation by the ultraviolet irradiation portion 52) is executed on a region adjacent to the above-mentioned region in the axis direction.

In this manner, when the images are printed on the whole region of the sheet S in the axis direction of the holding drum 31, the sheet S is removed from the holding drum 31 and is discharged to the sheet discharging portion 22. In this way, the printing operation ends.

Exemplary Structure of Ink Supply Unit 60

Figure 5:
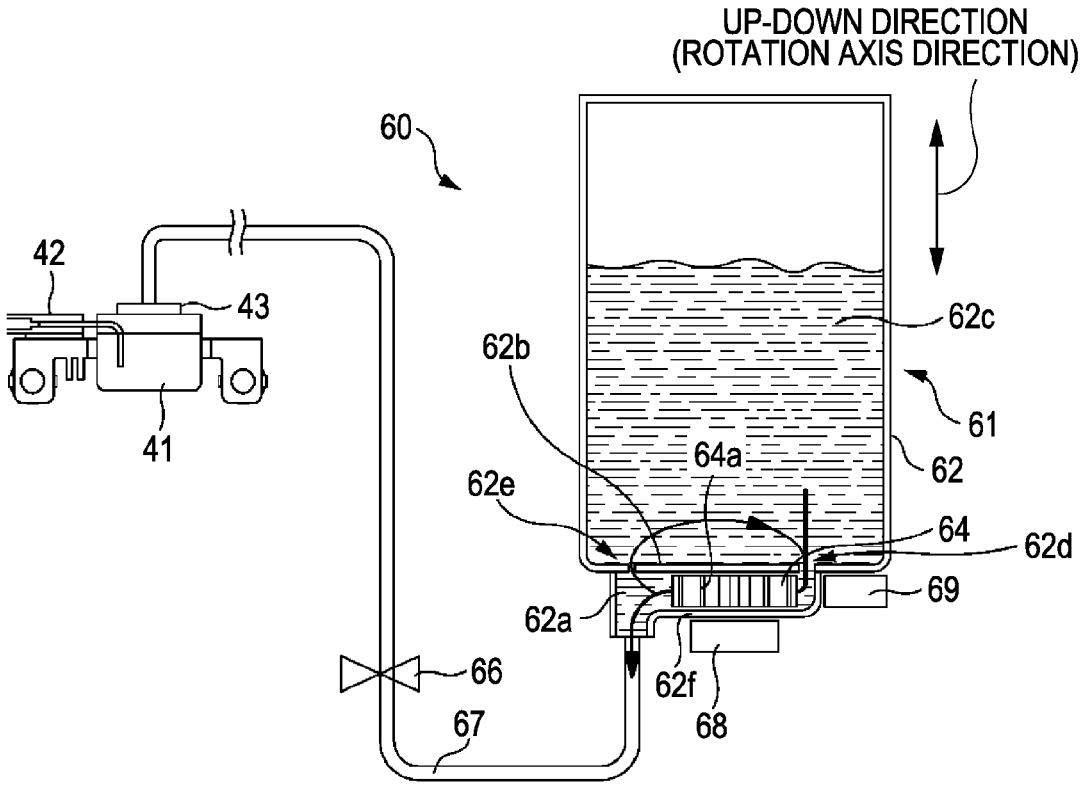
FIG. 5 is a schematic view showing a structure of an ink supply unit 60.
Figure 6:
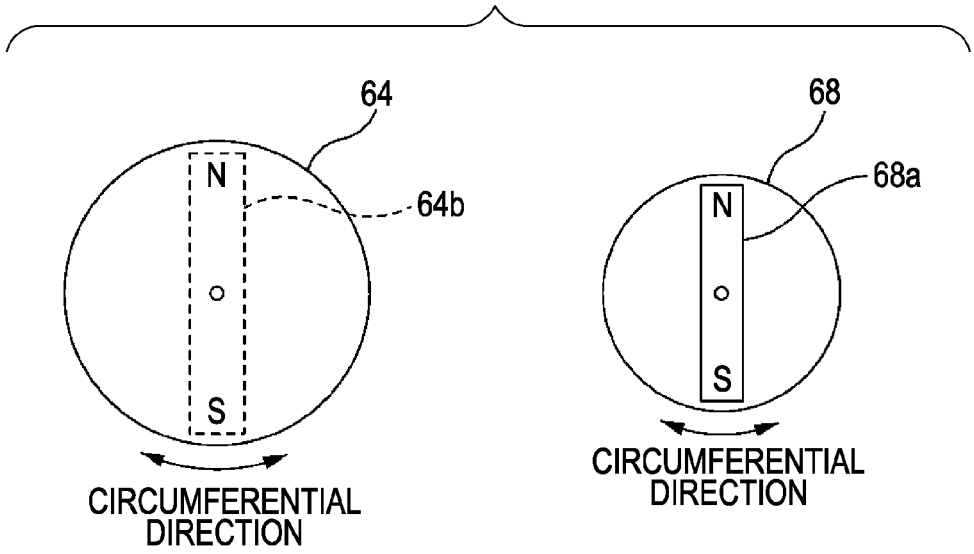
FIG. 6 is a schematic view of a magnetic rotor 64 and a driving member 68 in which a magnet is provided therein.
Figure 7:
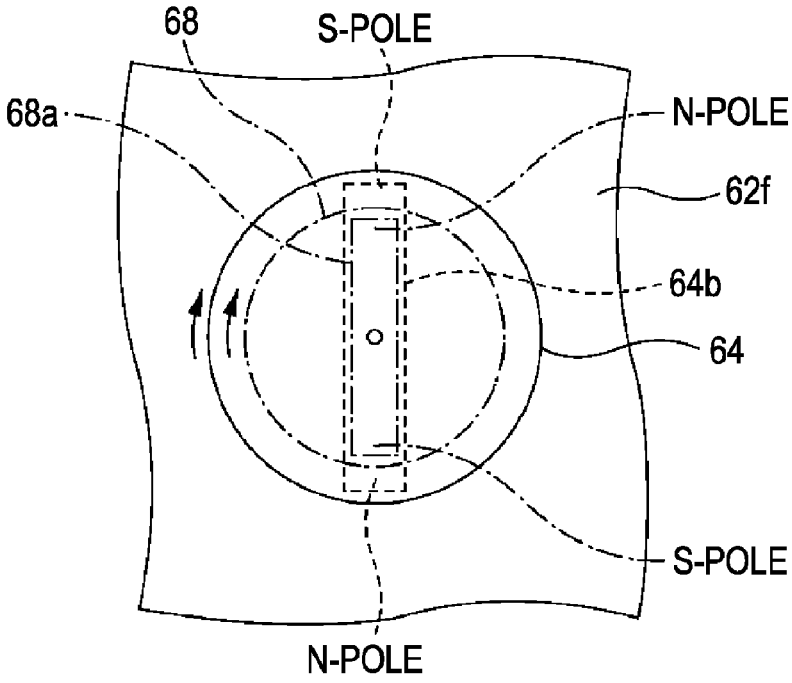
FIG. 7 is a schematic view of the driving member 68 and the magnetic rotor 64 when the magnetic rotor 64 is rotated by the driving member 68.

FIG. 5 is a schematic view showing a structure of the ink supply unit 60. FIG. 6 is a schematic view of a magnetic rotor 64 and a driving member 68 in which a magnet is provided therein. FIG. 7 is a schematic view of the driving member 68 and the magnetic rotor 64 when the magnetic rotor 64 is rotated by the driving member 68.

Although in the present embodiment, a plurality of ink supply units 60 is provided for each color of ink (that is, the respective ink supply units 60 supply ink of different colors to a corresponding head 42, the ink supply units 60 have the same structure. Therefore, in the following description, the ink supply unit 60 that supplies yellow ink will be described as an example.

As shown in FIG. 5, the ink supply unit 60 includes an ink cartridge 61 which is provided with an ink storage portion 62 as an example of a storage portion and a magnetic rotor 64 as an example of a rotating member, a supply path 67 as an example of a flow path, an ink supply valve 66 as an example of a valve, and a driving member 68. The ink cartridge 61 is a member that is configured to be detachable from a printer body which is a liquid storage device body.

The ink storage portion 62 stores ink (in this example, yellow ink) therein that is to be supplied to the storage chamber 43 of the head unit 40. The liquid level of ink in the ink storage portion 62 decreases in response to the supply (in other words, consumption) of ink to the storage chamber 43. The ink is supplied to the storage chamber 43 until an ink end occurs. Here, the ink end means a state in which the amount of ink stored in the ink storage portion 62 is very little (including a state in which the ink of the ink storage portion 62 is exhausted). When the ink end occurs, the ink cartridge 61 is detached by a user and a new ink cartridge 61 is mounted on the printer body.

The supply path 67 is a flow path which is connected to the storage chamber 43 and the ink storage portion 62 and through which ink delivered from the ink storage portion 62 and supplied to the storage chamber 43 flows. The ink supply valve 66 is a valve for opening/closing the supply path 67.

The magnetic rotor 64 is configured to rotate to thereby deliver ink from the ink storage portion 62. The magnetic rotor 64 has a generally cylindrical shape and rotates about a rotation shaft which is positioned at the center of a circle and extends in the up-down direction.

As shown in FIG. 5, the magnetic rotor 64 is provided in a bottom portion at inside of the ink storage portion 62. More specifically, in the bottom of the ink storage portion 62, the ink storage portion 62 is divided by a partition wall 62*b*, whereby a magnetic rotor accommodation chamber 62*a* for accommodating therein the magnetic rotor 64 is formed. In the following description, an inner portion of the ink storage portion 62 other than the magnetic rotor accommodation chamber 62*a*, that is, a portion disposed above the partition wall 62*b* will be referred to as a main chamber 62*c* for convenience sake. The magnetic rotor 64 is installed in the magnetic rotor accommodation chamber 62*a*.

In the magnetic rotor 64, a plurality of blade portions 64*a* (FIG. 5) extending radially in the horizontal direction from the rotation shaft is provided so that the respective blade portions 64*a* are arranged at regular intervals in the circumferential direction. When the magnetic rotor 64 rotates, the ink is pressed by the blade portions 64*a* which are moved with the rotation of the magnetic rotor 64, so that the ink is delivered from the ink storage portion 62. Moreover, in the above-described partition wall 62*b*, an inflow opening 62*d* is formed so as to introduce ink positioned within the main chamber 62*c* into the magnetic rotor accommodation chamber 62*a*. When the magnetic rotor 64 rotates, an ink flow is formed such that the ink introduced to the magnetic rotor accommodation chamber 62*a* from the main chamber 62*c* through the inflow opening 62*d* is delivered from the ink storage portion 62 (see the bold arrow in FIG. 5).

Moreover, the magnetic rotor 64 has a function of agitating the ink in the ink storage portion 62. That is, in the above-described partition wall 62*b*, an outflow opening 62*e* for causing the ink to flow out of the magnetic rotor accommodation chamber 62*a* into the main chamber 62*c* is provided. When the magnetic rotor 64 rotates, an ink flow is formed such that the ink introduced from the main chamber 62*c* into the magnetic rotor accommodation chamber 62*a* through the inflow opening 62*d* returns from the magnetic rotor accommodation chamber 62*a* to the main chamber 62*c* through the outflow opening 62*e* (see the narrow arrow in FIG. 5). In this way, the ink in the ink storage portion 62 is appropriately agitated.

In the printer 1 according to the present embodiment, it is possible to determine presence of ink in the ink storage portion 62 by rotating the magnetic rotor 64. Here, "determine the presence of ink in the ink storage portion 62" is used in a broad sense of its meaning and includes not only determining whether or not the ink in the ink storage portion 62 is completely consumed, but also determining whether or not the amount of ink in the ink storage portion 62 has become very little. That is, in the printer 1 according to the present embodiment, it is determined whether the ink end occurs by rotating the magnetic rotor 64.

That is, the magnetic rotor 64 is used as a pump member for delivering the ink from the ink storage portion 62 and as an agitating member for agitating the ink in the ink storage portion 62 and is also used for ink end determination. Details of the ink end determination will be described later.

The driving member 68 is configured to drive the magnetic rotor 64 by magnetic force. As shown in FIG. 5, the driving member 68 is provided at outside of the ink storage portion 62 so as to oppose the magnetic rotor 64 with a bottom wall 62*f* of the ink storage portion 62 disposed therebetween. That is, the driving member 68 is provided in a non-contact state with respect to the magnetic rotor 64.

The driving member 68 has a generally cylindrical shape and includes a rotation shaft which is positioned at the center of a circle and extends in the up-down direction. The rotation shaft is positioned approximately on an extension line of the rotation shaft of the magnetic rotor 64. When the driving member 68 rotates about the rotation shaft thereof upon receipt of driving force from a not-shown motor, the magnetic rotor 64 is rotated.

The principle in which the magnetic rotor 64 is rotated by the driving member 68 will be described with reference to FIGS. 6 and 7. As shown in the left figure of FIG. 6, a magnet (hereinafter, referred to as rotor magnet 64*b*) is provided in the magnetic rotor 64. The rotor magnet 64*b* is provided so that the above-mentioned rotation shaft of the magnetic rotor 64 is positioned at the center in the longitudinal direction thereof, and that the N and S poles are positioned in the vicinity of the circumference in the radial direction thereof. Moreover, the rotor magnet 64*b* is positioned on the lower side of the magnetic rotor 64 in the up-down direction (that is, close to the driving member 68). Since the left figure of FIG. 6 is a top view of the magnetic rotor 64, the rotor magnet 64*b* is invisible and thus the rotor magnet 64*b* is denoted by dotted lines.

As shown in the right figure of FIG. 6, a magnet (hereinafter, referred to as driving member magnet 68*a*) is provided in the driving member 68. Similar to the rotor magnet 64*b*, the driving member magnet 68*a* is provided so that the above-mentioned rotation shaft of the driving member 68 is positioned at the center in the longitudinal direction thereof, and that the N and S poles are positioned in the vicinity of the circumference in the radial direction thereof. However, unlike the rotor magnet 64*b*, the driving member magnet 68*a* is positioned on the upper side of the driving member 68 in the up-down direction (that is, close to the magnetic rotor 64). Since the right figure of FIG. 6 is a top view of the driving member 68, the driving member magnet 68*a* is visible and thus the driving member magnet 68*a* is denoted by solid lines.

When the driving member 68 rotates in response to driving force from the motor, the N pole (S pole) of the driving member magnet 68*a* is moved with the rotation of the driving member 68. However, in this case, by the attracting force (i.e., magnetic force) between the N pole and the S pole, force is generated in the magnetic rotor 64, causing the S pole (N pole) of the rotor magnet 64*b* to be moved along the circumferential direction while keeping track of the N pole (S pole) of the driving member magnet 68*a*. Moreover, as shown in FIG. 7, by the above-mentioned force, the magnetic rotor 64 is rotated with the rotation of the driving member 68 while the S pole (N pole) of the rotor magnet 64*b* maintains its state of being approximately opposed to the N pole (S pole) of the driving member magnet 68*a*.

Further, among the above-described detector array 70, a magnetic rotor detecting portion 69 as an example of a detecting portion (first detecting portion) is included. The magnetic rotor detecting portion 69 is capable of detecting a degree of rotation of the magnetic rotor 64. In the present embodiment, a hall element is used as the magnetic rotor detecting portion 69. As shown in FIG. 5, the magnetic rotor detecting portion 69 is provide at outside of the ink storage portion 62 so as to be adjacent to the magnetic rotor 64 in a direction (i.e., the horizontal direction) crossing the up-down direction. When the magnetic rotor 64 rotates, the N and S poles of the rotor magnet 64*b* provided in the magnetic rotor 64 alternately come close to the magnetic rotor detecting portion 69 every half-revolution of the magnetic rotor 64. When the N or S pole comes close thereto, electric current flows in the magnetic rotor detecting portion 69 by magnetic field generated by the pole. Therefore, in the present embodiment, the magnetic rotor detecting portion 69 is able to detect the rotation amount of the magnetic rotor 64 every half-revolution thereof.

The rotation amount detecting function of the magnetic rotor detecting portion 69 is used in the ink end determination (details thereof will be provided later).

Ink End Determination

As described above, the magnetic rotor 64 is used as a pump member for delivering the ink from the ink storage portion 62 and as an agitating member for agitating the ink in the ink storage portion 62 and is also used for ink end determination. In this specification, the principle of the ink end determination (that is, how the ink end determination can be made by rotating the magnetic rotor 64) will be described first, and thereafter, a detailed procedure of the ink end determination according to the present embodiment will be described.

Principle of Ink End Determination

Figure 8:
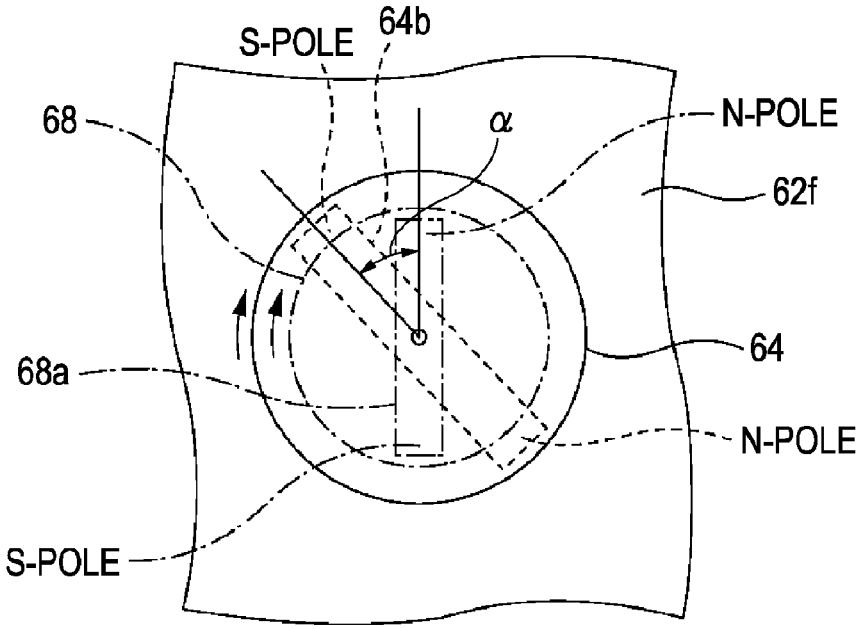
FIG. 8 is a schematic view showing a rotation state of the magnetic rotor 64 in a state in which the S pole (N pole) of a rotor magnet 64*b* lags behind the N pole (S pole) of a driving member magnet 68*a*.

The ink end determination is made by using a difference in the rotation behaviors of the magnetic rotor 64 between an ink end state and a non-ink end state. The behavior in the ink end state and the behavior in the non-ink end state will be described first with reference to FIGS. 7 and 8, and thereafter, the principle of the ink end determination will be described. FIG. 8 is a schematic view showing a rotation state of the magnetic rotor 64 in a state in which the S pole (N pole) of the rotor magnet 64*b* lags behind the N pole (S pole) of the driving member magnet 68*a*.

First, the rotation behavior of the magnetic rotor 64 in a non-ink end state will be described. As described above, when the driving member 68 rotates, the S pole (N pole) of the rotor magnet 64*b* keeps track of the N pole (S pole) of the driving member magnet 68*a*, whereby the magnetic rotor 64 is rotated in a state in which the S pole (N pole) of the rotor magnet 64*b* is approximately opposed to the N pole (S pole) of the driving member magnet 68*a* (see FIG. 7).

However, when the rotation speed of the driving member 68 is increased (hereinafter, the rotation speeds before acceleration and after acceleration will be referred to as low speed and medium speed, respectively, for convenience sake), the S pole (N pole) of the rotor magnet 64*b* becomes hard to keep track of the N pole (S pole) of the driving member magnet 68*a*. That is, when the rotation speed of the driving member 68 is increased, the magnetic rotor 64 is caused to rotate at the rotation speed with the S pole (N pole) of the rotor magnet 64*b* keeping track of the N pole (S pole) of the driving member magnet 68*a*. However, since the fluid resistance of ink acting on the rotating magnetic rotor 64 increases because of the increase in the rotation speed of the magnetic rotor 64, the S pole (N pole) of the rotor magnet 64*b* is prevented from keeping track of the N pole (S pole) of the driving member magnet 68*a*. Therefore, in such a case, the magnetic rotor 64 is unable to rotate in a state in which the S pole (N pole) of the rotor magnet 64*b* is opposed to the N pole (S pole) of the driving member magnet 68*a*. As shown in FIG. 8, the magnetic rotor 64 rotates in a state in which the S pole (N pole) of the rotor magnet 64*b* lags behind the N pole (S pole) of the driving member magnet 68*a* (the lag angle is denoted by symbol a in FIG. 8). Moreover, in such a case, a difference occurs between the rotation amount of the driving member 68 and the rotation amount of the magnetic rotor 64. That is, even after the driving member 68 is rotated one revolution, the rotation amount of the magnetic rotor 64 cannot reach one revolution. The magnetic rotor 64 is rotated one revolution when the rotation amount of the driving member 68 exceeds one revolution.

Further, when the rotation speed of the driving member 68 is further increased (hereinafter, the rotation speed after further acceleration will be referred to as high speed for convenience sake), the S pole (N pole) of the rotor magnet 64*b* won't keep track of the N pole (S pole) of the driving member magnet 68*a*. That is, when the rotation speed of the driving member 68 is further increased, the above-described fluid resistance of the ink increases more, whereby the lagging of the S pole (N pole) of the rotor magnet 64*b* from the N pole (S pole) of the driving member magnet 68*a* becomes more prominent (in other words, the above-described lag angle $\alpha$ increases more). When the lag angle $\alpha$ becomes 180 degrees (half-revolution), the S pole (N pole) of the rotor magnet 64*b* is in a state of being opposed to the S pole (N pole) of the driving member magnet 68*a*. When this state is overcome (that is, when the lag angle $\alpha$ exceeds 180 degrees), a distance from the S pole (N pole) of the rotor magnet 64*b* to the N pole (S pole) of the driving member magnet 68*a* in the rotation direction of the driving member 68 becomes larger than a distance from the S pole (N pole) of the rotor magnet 64*b* to the N pole (S pole) of the driving member magnet 68*a* in the reverse direction to the rotation direction of the driving member 68. Therefore, the magnetic rotor 64 stops rotating in the rotation direction of the driving member 68, and the N pole (S pole) of the driving member magnet 68*a* catches up the S pole (N pole) of the rotor magnet 64*b* with the rotation of the driving member 68, whereby the S pole (N pole) of the rotor magnet 64*b* is opposed to the N pole (S pole) of the driving member magnet 68*a*. Even after such a state is obtained, the above-described operations are repeated, so that the S pole (N pole) of the rotor magnet 64*b* is unable to keep track of the N pole (S pole) of the driving member magnet 68*a*. Moreover, in such a case, a difference of two revolutions or more occurs between the rotation amount of the driving member 68 and the rotation amount of the magnetic rotor 64. That is, a state may happen in which even after the driving member 68 is rotated two revolutions, the rotation amount of the magnetic rotor 64 cannot reach one revolution.

Next, the rotation behavior of the magnetic rotor 64 in an ink end sate will be described. When the ink end occurs, the fluid resistance of ink does not act on the rotating magnetic rotor 64 because of absence of ink. Therefore, regardless of whether the rotation speed of the driving member 68 belongs to any of low speed, medium speed and high speed, when the driving member 68 rotates, the S pole (N pole) of the rotor magnet 64*b* keeps track of the N pole (S pole) of the driving member magnet 68*a*. As a result, the magnetic rotor 64 is rotated in a state in which the S pole (N pole) of the rotor magnet 64*b* is opposed to the N pole (S pole) of the driving member magnet 68*a*.

In this manner, due to the presence of fluid resistance, a difference occurs in the rotation behaviors of the magnetic rotor 64 between the ink end state and the non-ink end state. That is, in the non-ink end state, a difference occurs between the rotation of the magnetic rotor 64 and the rotation of the driving member 68. On the other hand, in the ink end state, no difference occurs between them. Therefore, by detecting the degree of rotation of the magnetic rotor 64 by means of the magnetic rotor detecting portion 69 and acquiring difference information on rotation between the magnetic rotor 64 and the driving member 68 on the basis of the detection result, it is possible to determine whether or not the ink end occurs.

Detailed Procedure of Ink End Determination

Figure 9:
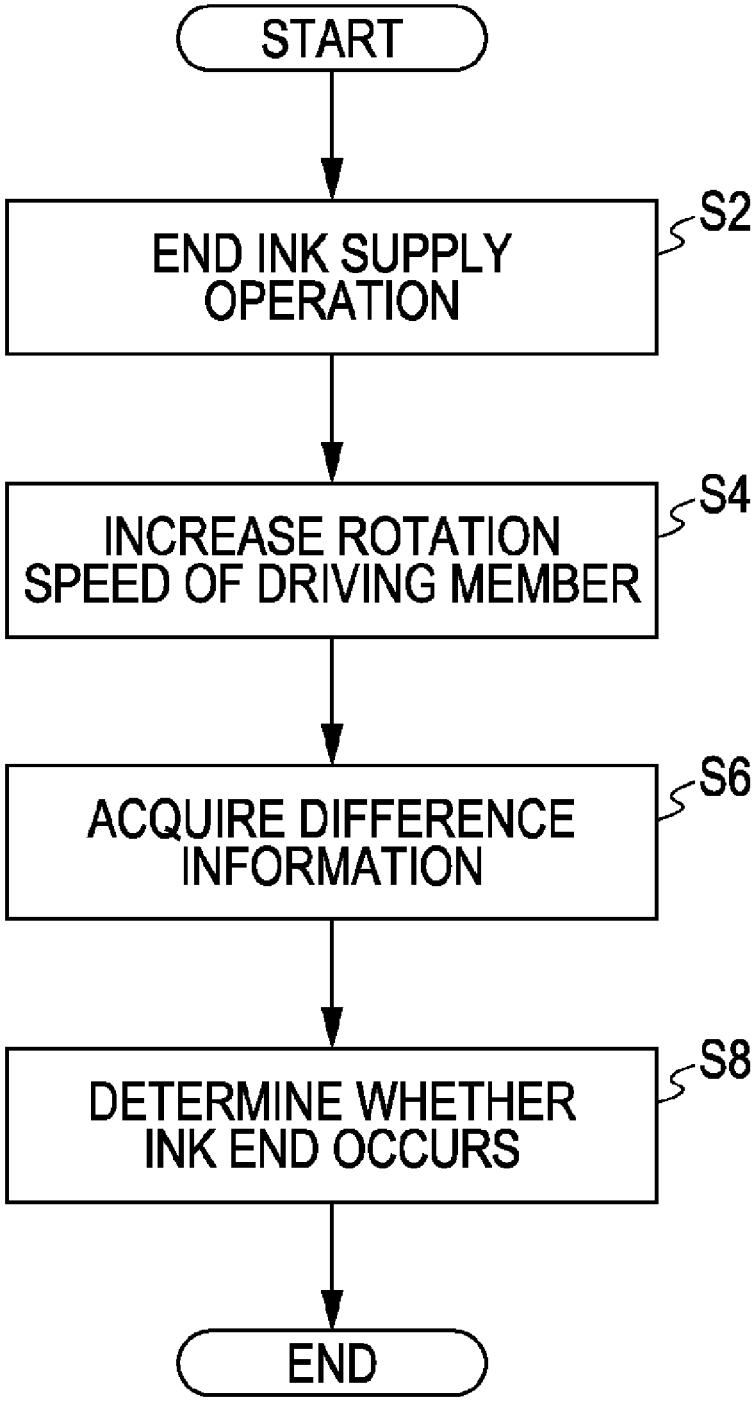
FIG. 9 is a flowchart of ink end determination.

Next, a detailed procedure of the ink end determination will be described with reference to FIG. 9. FIG. 9 is a flowchart of the ink end determination. Various operations during execution of the ink end determination are mainly carried out by the controller 10. That is, the controller 10 performs the function as a determining portion for determining the presence of the ink in the ink storage portion 62. In particular, in the present embodiment, the operations are carried out when the CPU 12 processes the programs stored in the memory 13. The programs are constructed from codes for executing various operations described later.

In the present embodiment, the ink end determination is executed right after the end of an ink supply operation of supplying ink to the storage chamber 43 from the ink storage portion 62, namely, right after the end of an operation wherein ink is delivered from the ink storage portion 62 by the rotation of the magnetic rotor 64. Therefore, the flowchart begins when the controller 10 ends the ink supply operation (step S2). Specifically, the ink supply operation ends when the controller 10 closes the open ink supply valve 66.

During execution of the ink supply operation, the ink delivery is performed by rotating the driving member 68 to allow the magnetic rotor 64 to rotate. In this case, in order to appropriately perform the delivery, it is necessary to allow the S pole (N pole) of the rotor magnet 64*b* to keep track of the N pole (S pole) of the driving member magnet 68*a*. For this reason, it is necessary that the rotation speed of the driving member 68 during execution of the ink supply operation is set to a speed (that is, the above-described low speed or medium speed) at which the tracking is realized. In the present embodiment, it will be assumed that the rotation speed of the driving member 68 during execution of the ink supply operation is set to the medium speed.

Moreover, in the present embodiment, it is necessary that the ink end determination is executed right after the end of the ink supply operation, and that the magnetic rotor 64 is rotated during the ink end determination. Therefore, the rotation of the magnetic rotor 64 is not stopped at the end of the ink supply operation, but the magnetic rotor 64 is still rotating even after the end of the ink supply operation. That is, at the time point at which the ink supply operation ends, the magnetic rotor 64 is rotating with the rotation of the driving member 68 of which the rotation speed is set to the medium speed.

Next, the controller 10 starts execution of the ink end determination. First, the controller 10 increases the rotation speed of the driving member 68 (step S4). As described above, in order to appropriately execute the ink end determination, in the non-ink end state, it is necessary to make a difference between the rotation of the magnetic rotor 64 and the rotation of the driving member 68. Therefore, it is necessary that the rotation speed of the driving member 68 during the ink end determination is set to the above-described medium speed or high speed. In the present embodiment, the rotation speed of the driving member 68 during the ink end determination is set to the high speed at which the difference occurs more easily. That is, the controller 10 receives an instruction for setting the rotation speed of the driving member 68 to the high speed (hereinafter, the instructed rotation speed will be represented by V), and increases the rotation speed of the driving member 68 from medium speed to high speed.

Next, the controller 10 acquires a detection result from the magnetic rotor detecting portion 69 to thereby acquire difference information on rotation between the magnetic rotor 64 and the driving member 68 on the basis of the detection result (step S6). More specifically, the controller 10 calculates how much the magnetic rotor 64 is rotated per predetermined time period T (i.e., the rotation amount X1 per predetermined time period T of the magnetic rotor 64) on the basis of the detection result from the magnetic rotor detecting portion 69. Moreover, the controller 10 calculates the instructed rotation amount X2 per predetermined time period T of the driving member 68 from the instructed rotation speed V based on a calculation formula X2=V×T. Then, the controller 10 calculates the difference ΔX based on a calculation formula ΔX=X2−X1. In this manner, in the present embodiment, the controller 10 acquires the difference ΔX between the rotation amount X1 per predetermined time period T of the magnetic rotor 64 and the instructed rotation amount X2 per predetermined time period T of the driving member 68 as the difference information on the basis of the detection result by the magnetic rotor detecting portion 69.

Next, the controller 10 determines whether or not the ink end occurs on the basis of the difference information (difference ΔX) (step S8). The difference ΔX has a value near 0 in the ink end state, and the difference ΔX has a very large value in the non-ink end state. In this way, the controller 10 is able to determine whether or not the ink end occurs. In a practical case, a minimum physical amount Th that causes reaction is set. When a relation of ΔX<Th is satisfied, it is determined that the ink end occurs. When a relation of ΔX>Th is satisfied, it is determined that the ink end does not occur.

When a determination that the ink end occurs is obtained, the controller 10 informs a user of the occurrence of the ink end in order to prompt the user to replace the ink cartridge 61.

As described above, the printer 1 according to the present embodiment includes: the ink storage portion 62 that is configured to store therein ink, the magnetic rotor 64 that is provided in the bottom portion at inside of the ink storage portion 62 so as to be capable of rotating, the driving member 68 that is provided at outside of the ink storage portion 62 in a non-contact state with respect to the magnetic rotor 64 so as to drive the magnetic rotor 64 by magnetic force, the driving member 68 rotating to allow the magnetic rotor 64 to rotate, the magnetic rotor detecting portion 69 that is capable of detecting the degree of rotation of the magnetic rotor 64, and the determining portion (controller 10) that is capable of acquiring the difference information on rotation between the magnetic rotor 64 and the driving member 68 on the basis of the detection result by the magnetic rotor detecting portion 69 and determining the presence of ink in the ink storage portion 62 on the basis of the difference information. Therefore, even when a sensor or the like for detecting the liquid level of the ink in the ink storage portion is not provided, it is possible to appropriately make the ink end determination. That is, according to the printer 1 of the present embodiment, it is possible to provide a novel and effective ink end determination method which is not known in the related art.

In the printer 1 according to the present embodiment, the magnetic rotor 64 is configured to have a function of the pump member for delivering ink from the ink storage portion 62. Owing to such a configuration, since the pump member is used for the ink end determination without preparing a new member for the ink end determination, the members can be efficiently utilized. Furthermore, in the printer 1 according to the present embodiment, since the magnetic rotor 64 is configured to have a function of the agitating member for agitating ink in the ink storage portion 62, the members can be more efficiently utilized.

In the printer 1 according to the present embodiment, the magnetic rotor detecting portion 69 is configured to detect the degree of rotation of the magnetic rotor 64 when the ink supply valve 66 is closed and make the ink end determination on the basis of the detection result. Therefore, since the ink end determination can be performed in a state in which the delivery of ink from the ink storage portion 62 to the storage chamber 43 is not performed, that is, in a state in which the ink in the ink storage portion 62 is stabilized, it is possible to make the ink end determination in an accurate manner.

MODIFICATION OF EMBODIMENT

Figure 10:
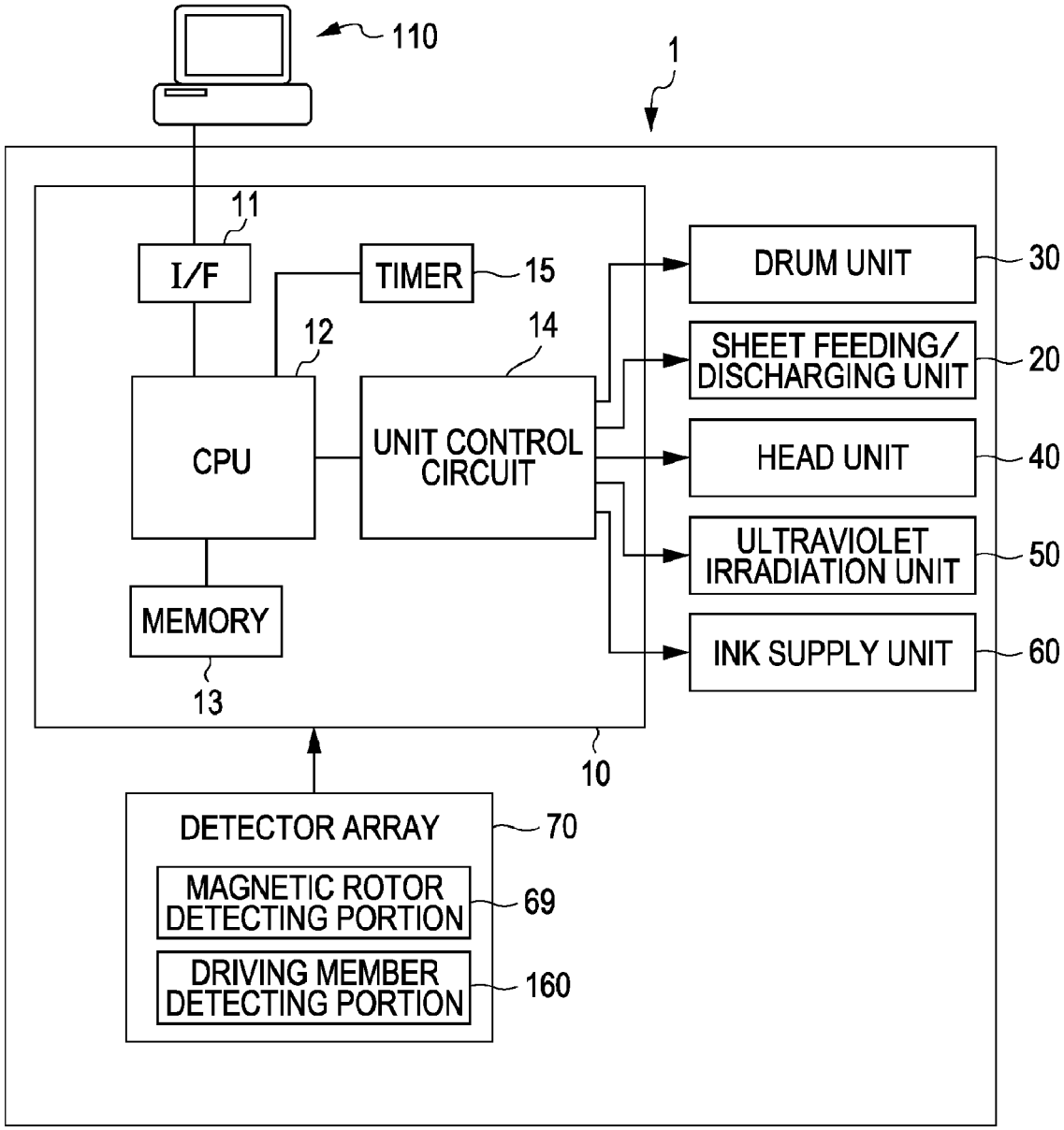
FIG. 10 is a block diagram showing the entire structure of a printer 1 according to a second embodiment of the invention.

A modification (hereinafter, sometimes referred to as a second embodiment) of the above-described embodiment (hereinafter, sometimes referred to as a first embodiment) will be described with reference to FIG. 10. FIG. 10 is a block diagram showing the entire structure of a printer 1 according to a second embodiment of the invention.

In the first embodiment, in step S6 of FIG. 9, the controller 10 acquires the difference ΔX between the rotation amount X1 per predetermined time period T of the magnetic rotor 64 and the instructed rotation amount X2 per predetermined time period T of the driving member 68 as the difference information on the basis of the detection result by the magnetic rotor detecting portion 69. However, the invention is not limited to this, but an example may be considered in which the controller 10 acquires a difference between the rotation amounts per predetermined time period of the magnetic rotor 64 and the driving member 68 as the difference information on the basis of the detection results by the magnetic rotor detecting portion 69 and a second detecting portion for detecting the rotation amount of the driving member 68.

That is, as shown in FIG. 10, in the printer 1 according to the second embodiment, in addition to the magnetic rotor detecting portion 69, a driving member detecting portion 160 as an example of a second detecting portion for detecting the rotation amount of the driving member 68 is provided. The driving member detecting portion 160 may be a so-called encoder or may be the hall element. Moreover, similar to the first embodiment, the controller 10 of the printer 1 calculates how much the magnetic rotor 64 is rotated per predetermined time period T (the rotation amount X1 per predetermined time period T of the magnetic rotor 64) on the basis of the detection result from the magnetic rotor detecting portion 69. However, unlike the first embodiment, the controller 10 does not calculate the instructed rotation amount X2 per predetermined time period T of the driving member 68 but calculates how much the driving member 68 is rotated per predetermined time period T (the rotation amount X2 per predetermined time period T of the driving member 68) on the basis of the detection result from the driving member detecting portion 160. Then, the controller 10 calculates the difference ΔX between them based on a calculation formula ΔX=X2−X1 and uses the difference ΔX as the difference information. In this manner, similar to the first embodiment, the ink end determination is performed on the basis of the difference information.

According to the printer 1 of the second embodiment, similar to printer 1 of the first embodiment, it is possible to provide a novel and effective ink end determination method which is not known in the related art. When the first and second embodiments are compared, the first embodiment is advantageous in that the device structure can be simplified because the driving member detecting portion 160 is not necessary. On the other hand, the second embodiment is advantageous in that the ink end determination can be performed in a more accurate manner because the difference information is acquired using the actually detected rotation amount of the driving member rather than using the instructed rotation amount.

OTHER EMBODIMENTS

Although the printer as the exemplary embodiments has been discussed herein, these embodiments are given not for limiting the invention but only for easy understanding of the invention. Various modifications and improvements may be made without departing from the scope and spirit of the invention, and equivalents thereof are thus encompassed by the invention. Particularly, the following examples are included within the scope of the invention.

In the previously described embodiment, the liquid storage device is embodied in the ink jet printer. However, the invention is not limited to this, and may be embodied in a liquid storage device storing therein other liquid except ink (besides liquid, including a liquid medium wherein particles of functional materials are dispersed, and a fluid medium such as gel). For example, a liquid storage device storing therein a liquid medium containing, in a dispersed or dissolved form, a material such as an electrode material, a color material or the like used for manufacture of a liquid crystal display, an EL (electro luminescence) display, a field emission display, or the like, a liquid storage device storing therein a bio-organic substance used for manufacture of a biochip, and a liquid storage device capable of being used as a precision pipette and storing liquid therein serving as a sample may be employed. Further, a liquid storage device storing therein lubricating oil ejected at pint point to a precision machine such as a watch, a camera, or the like, a liquid storage device storing therein a transparent resin liquid such as an ultraviolet curable resin ejected on a substrate for forming a fine hemispherical lens (optical lens) for use in an optical communication element or the like, a liquid storage device storing therein an etching liquid such as an acid liquid, an alkali liquid, or the like, ejected for etching a substrate or the like, a fluid medium storage device storing therein a gel to be ejected, and the like may also be employed. Then, the invention can be applied to any one of such storage devices.

In the embodiments described above, although an example in which the difference between the rotation amount per predetermined time period of the magnetic rotor 64 and the instructed rotation amount per predetermined time period of the driving member 68 is acquired as the difference information on rotation between the magnetic rotor 64 and the driving member 68, and an example in which the difference in the rotation amount per predetermined time period between the magnetic rotor 64 and the driving member 68 is acquired as the difference information are described, the invention is not limited to this.

For example, a difference between the rotation speed of the magnetic rotor 64 and the instructed rotation speed of the driving member 68 may be acquired as the difference information, and a difference in the rotation speeds between the magnetic rotor 64 and the driving member 68 may be acquired as the difference information. In such cases, the magnetic rotor detecting portion 69 (the driving member detecting portion 160) may directly detect the rotation speed without detecting the rotation amount as the degree of rotation of the magnetic rotor 64 (the driving member 68).

Moreover, when any one of the magnetic rotor 64 and the driving member 68 is rotated by a predetermined rotation amount, the degree of rotation of the other one may be calculated, thereby acquiring the difference between the rotation amounts of them as the difference information. For example, a time period required for the magnetic rotor 64 to be rotated N revolutions is calculated on the basis of the detection result by the magnetic rotor detecting portion 69 (the required time period will be represented by T), the rotation amount of the driving member 68 during the time period T is calculated by the product of the instructed rotation speed V and the time period T, and the difference between the rotation amount of the driving member 68 and the rotation amount (the rotation amount for N revolutions) of the magnetic rotor 64 is acquired as the difference information. Moreover, a time period required for the magnetic rotor 64 to be rotated N revolutions is calculated on the basis of the detection result by the magnetic rotor detecting portion 69 (the required time period will be represented by T), the rotation amount of the driving member 68 during the time period T is calculated on the basis of the detection result by the driving member detecting portion 160, and the difference between the rotation amount of the driving member 68 and the rotation amount (the rotation amount for N revolutions) of the magnetic rotor 64 is acquired as the difference information. Furthermore, a time period required for the driving member 68 to be rotated N revolutions is calculated on the basis of the detection result by the driving member detecting portion 160 (the required time period will be represented by T), the rotation amount of the magnetic rotor 64 during the time period T is calculated on the basis of the detection result by the magnetic rotor detecting portion 69, and the difference between the rotation amount of the magnetic rotor 64 and the rotation amount (the rotation amount for N revolutions) of the driving member 68 is acquired as the difference information.

What is claimed is:

1. A liquid storage device comprising:

a storage portion that is configured to store liquid therein, a rotating member that is provided in a bottom portion at inside of the storage portion so as to be capable of rotating, a driving member that is provided at outside of the storage portion in a non-contact state with respect to the rotating member so as to drive the rotating member by magnetic force, the driving member rotating to allow the rotating member to rotate, a detecting portion that is capable of detecting a degree of rotation of the rotating member, and a determining portion that is capable of acquiring difference information of rotation between the rotating member and the driving member on the basis of a detection result by the detecting portion and determining presence of liquid in the storage portion on the basis of the difference information.

2. The liquid storage device according to claim 1, wherein the detecting portion detects a rotation amount of the rotating member as the degree of rotation, and wherein the determining portion is configured to:

acquire a difference between the rotation amount per predetermined time period of the rotating member and an instructed rotation amount per predetermined time period of the driving member as difference information on the basis of the detection result by the detecting portion, and determine the presence of liquid in the storage portion on the basis of the difference.

3. The liquid storage device according to claim 1, wherein the detecting portion is a first detecting portion and includes a second detecting portion for detecting the rotation amount of the driving member, wherein the first detecting portion detects the rotation amount of the rotating member as the degree of rotation, and wherein the determining portion is configured to:

acquire a difference in the rotation amount per predetermined time period between the rotating member and the driving member as the difference information on the basis of the detection results by the first detecting portion and the second detecting portion, and determine the presence of liquid in the storage portion on the basis of the difference.

4. The liquid storage device according to claim 1, wherein the rotating member is a pump member for delivering the liquid from the storage portion.

5. The liquid storage device according to claim 4, further comprising a flow path which is connected to the storage portion and through which the liquid delivered from the storage portion by the pump member flows and a valve for opening/closing the flow path, wherein the detecting portion detects the degree of rotation of the rotating member when the valve is closed.

6. The liquid storage device according to claim 1, wherein the rotating member is an agitating member for agitating the liquid in the storage portion.

7. A liquid presence determining method comprising the steps of:

allowing a rotating member provided in a bottom portion at inside of a storage portion storing liquid therein to rotate by rotating a driving member provided at outside of the storage portion in a non-contact state with respect to the rotating member, the driving member driving the rotating member by magnetic force, thereby detecting a degree of rotation of the rotating member, and acquiring difference information on rotation between the rotating member and the driving member on the basis of a detection result and determining presence of liquid in the storage portion on the basis of the difference information.

* * * * *